US008667907B2

(12) United States Patent
Grace

(10) Patent No.: US 8,667,907 B2
(45) Date of Patent: Mar. 11, 2014

(54) PORTABLE AND COLLAPSIBLE TABLE STRUCTURE

(75) Inventor: Daniel R. Grace, Old Saybrook, CT (US)

(73) Assignee: Rio Brands, LLC, West Conshohocken, PA (US)

( * ) Notice: Subject to any disclaimer, the term of this patent is extended or adjusted under 35 U.S.C. 154(b) by 0 days.

(21) Appl. No.: 13/343,355

(22) Filed: Jan. 4, 2012

(65) Prior Publication Data

US 2012/0204770 A1 Aug. 16, 2012

Related U.S. Application Data

(60) Provisional application No. 61/429,616, filed on Jan. 4, 2011.

(51) Int. Cl.
*A47B 3/02* (2006.01)

(52) U.S. Cl.
USPC ..... 108/116

(58) Field of Classification Search
USPC ..... 108/83–89, 157.1, 157.17, 157.18, 108/159.12, 127; 5/110
See application file for complete search history.

(56) References Cited

U.S. PATENT DOCUMENTS

| | | | | | |
|---|---|---|---|---|---|
| 1,608,924 | A * | 11/1926 | Brown | 108/118 |
| 1,706,192 | A * | 3/1929 | Smith | 108/34 |
| 3,168,061 | A * | 2/1965 | Bedol | 108/116 |
| 3,462,773 | A * | 8/1969 | Triplett | 5/111 |
| 3,491,705 | A * | 1/1970 | Blanke | 108/49 |
| 3,980,026 | A * | 9/1976 | Thomas | 108/83 |
| 6,840,182 | B2 * | 1/2005 | Price | 108/101 |
| 2009/0178195 | A1 * | 7/2009 | Zheng | 5/111 |

* cited by examiner

*Primary Examiner* — Matthew Ing
(74) *Attorney, Agent, or Firm* — McCormick, Paulding & Huber LLP

(57) ABSTRACT

A portable and collapsible table structure comprises a tabletop, a table frame, and a plurality of folding legs pivotally attached to the table frame. The tabletop is independently collapsed to a bundled condition, for example, by folding or rolling. Similarly, the table frame and the folding legs are collapsed so as to minimize the amount of space taken up by the collapsed and bundled table frame and legs. The bundled tabletop and the collapsed table frame and legs can be further bundled or packed together for transport and/or storage. The table frame comprises adjustable members that permit the size and footprint of the table frame to be expanded to multiple usable table sizes without compromising the size of the collapsed and bundled table. The folding legs may be adjustable to reduce the size taken up by the legs in the compressed and bundled condition of the table.

17 Claims, 14 Drawing Sheets

PORTABLE AND COLLAPSIBLE TABLE STRUCTURE

CROSS-REFERENCE TO RELATED APPLICATION

This application claims the benefit of U.S. Provisional Application No. 61/429,616, filed Jan. 4, 2011, the disclosure of which is incorporated herein by reference in its entirety.

FIELD OF THE INVENTION

This invention relates in general to collapsible articles of furniture and more particularly to a portable and collapsible table structure.

BACKGROUND OF THE INVENTION

The present invention is concerned with improvements in portable and collapsible outdoor furniture of simple durable quality construction which may be collapsed to minimal size to satisfy the needs of the average user, including campers, picnickers, and the like, and for marketing at a reasonable price to satisfy the requirements of mass marketing. In particular, the present invention is directed to a portable and collapsible table structure that can easily be set-up for use, and broken down to a compact bundle for convenient transport and storage.

Common portable table designs include standard folding tables consisting of a tabletop fixed to folding legs mounted thereunder. To set up such a table, the legs are folded out and locked into a set-up position. To collapse the table for storage, the legs are unlocked and folded within the footprint of the tabletop. Such folding tables are not desirable or convenient for transport because the folded footprint of the table is often identical to the set-up footprint of the table, and thus may not easily fit within the user's vehicle. Typically, a truck, van or large SUV is needed just to transport the table, and even then, the user must compromise other storage space or even seating space in the vehicle. In some alternative designs, the table top may be folded in half after the legs are collapsed, but such tables are still very heavy and bulky, and thus not easily transported. Additionally, traditional folding table designs take up a lot of storage space, for example in a closet or basement, even when folded up.

Some portable table designs can be collapsed or broken down into more compact sizes for transport and storage. For example, the tabletop, table support, and table legs can be broken down, folded up, and bundled together for easy transport. In some designs, for example, the tabletop is removed from a table frame and separately folded into a smaller condition. The table frame and legs are separately folded up and collapsed into a bundle. Such tables are especially useful for camping, picnics and travel, where standard tables, including traditional folding tables, are often too bulky and difficult to transport without taking up too much vehicle space.

However, the usable size of such prior art portable table designs is often limited based on how such tables may be broken down and bundled. For example, it is often the case that in order to decrease the size of the bundle of a collapsed table, the table structure, as set up, must itself be small. However, when the size of the table itself is decreased, the table is often too small for many desired uses. Thus, while storage and transport space has been optimized in some regards, the utility of the table may be undesirable, and when a larger table surface is desired, one may need to use two or more small tables together, which ends up requiring more storage and transportation space than a single, larger table. Alternatively, where a larger table surface is desired using a single collapsible table, the size of the collapsed table with a larger tabletop and frame footprint may be too large, bulky and difficult to carry, even when collapsed and bundled. Thus, heretofore it has been difficult to have a portable table that will take up a minimal storage space when broken down without compromising the size of the set-up table.

In view of the foregoing, there is a need for a new and improved portable and collapsible table structure that overcomes the problems and drawbacks associated with prior art collapsible tables. Accordingly, it is a general object of the present invention to provide a table structure designed to be collapsed into a minimally-sized bundle for convenient transport and storage, but which can also be easily set-up and expanded to a variety of sizes for use without compromising the size of the collapsed bundle. Further, it is a general object of the present invention to provide a table structure that is easily collapsed to a minimally-sized bundle without requiring a complicated or cumbersome collapsing procedure, and while keeping the components of at least the table frame in a unitary, integrated design with a minimal number of separate pieces to keep track of during set up, break down, storage and transportation.

SUMMARY OF THE INVENTION

In accordance with an embodiment of the present invention, there is provided a collapsible table comprising a tabletop, a table frame, and a plurality of folding legs pivotally attached to the table frame. Preferably, the tabletop can be independently collapsed to a compressed condition, for example, by folding or rolling. Similarly, the table frame and the folding legs can be collapsed into a condition where all of the frame members and legs are generally parallelly disposed so as to minimize the amount of space taken up by the collapsed table frame and legs. The collapsed tabletop and the collapsed table frame and legs can be further bundled or packed together for transport and/or storage. Preferably, the bundled table can be easily stored in a travel bag so as to keep all parts of the table together for easy set-up.

In a first aspect of the present invention, the table frame comprises adjustable members that permit the size and footprint of the table frame to be expanded to multiple usable table sizes. The tabletop can be correspondingly sized for use with each of the possible sizes of the table frame, or alternatively, the table bundle can be provided with multiple tabletop pieces that can be individually used or combined to accommodate each of the possible sizes of the expandable table frame.

In a preferred design of the present invention, the table frame comprises a pair of telescoping rails that can be adjusted to increase the length of the table frame as desired. In a more preferred design of the present invention, the pair of telescoping rails comprises an outer rail member and an inner rail member telescopically disposed therein. In such an embodiment, the outer rail member defines an interior cavity for receiving the inner rail member wherein the interior cavity is not blocked by any structural components so that the inner rail member can telescope within substantially the entire length of the rail member to reduce the collapsed size of the table frame for storage and transport.

In a preferred design of the present invention, at least two leg assemblies are pivotally connected to the table frame, each leg assembly comprising a first leg and a second leg pivotally connected together and relatively movable between an open position and a closed position. In the open position, the first and second legs are disposed in a generally X-shaped condition. In the closed position, the first and second legs are disposed in a generally parallel condition.

In another aspect of the present invention, means are provided for locking the table frame and legs in the set-up condition of the table. For example, linking members may be provided between each of the legs and the table frame so as to lock the table in the set-up position during use and prevent buckling of any of the legs or the table frame when a load is applied to the tabletop. In a preferred design of the present invention, the locking means are affixed between each leg and the table frame so as to minimize the complexity of setting up and breaking down the table frame. That is, the locking means stay attached to both the frame and an associated leg even when the leg is moving in relation to the frame, or when the frame is being adjusted to increase or decrease the table size. In this regard, the locking means preferably have an over-the-center linkage design conventionally used with folding tables that can be folded with movement of a leg to permit collapsing of the leg, and that can be locked in place when the leg is fully extended relative to the table frame in the set-up condition of the table.

In an alternative embodiment of the present invention, the locking means may be disengaged from the table frame, the legs or both when the table is to be collapsed. Accordingly, the locking means are used when the table is in its set-up condition, but removed, in whole or in part, when the table is being broken down so as not to interfere with the collapsing of the table. Additionally, such locking means are easily usable with the table frame even when expanded to larger table sizes.

In another aspect of the present invention, the legs are extendable to different lengths. In this manner, the size of the legs can be reduced during break down of the table, which in turn reduces the size of the collapsed table structure, thereby taking up less space when the table is collapsed and bundled. Preferably, the reduced size of the legs corresponds to the smallest length of the adjustable table frame. In a preferred embodiment of the present invention, the reduced size of the legs corresponds to smallest length of the inner rail member completely telescoped within the outer rail member. In a more preferable embodiment of the present invention, the reduced size of the legs corresponds to the width of the tabletop.

Lengthwise adjustment of the legs will also permit the user to adjust the height of the set-up table, as desired. In a preferred design of the present invention, the legs comprise telescoping members that may lock into place at predetermined lengths. Additionally, one of the legs may be provided with additional adjustment means so as to act as a leveling leg so that the table can be leveled in the set-up condition on an uneven surface, such as a beach, campsite or grass field.

The tabletop of the present invention preferably comprises one or more slatted tabletop sections, each formed by a series of interconnected slats that define a substantially horizontal planar tabletop surface in a set-up condition, and that extend in a common direction to form a compact bundle in a collapsed condition. The table of the present invention also preferably includes means for releasably securing the tabletop in its set-up condition in assembly with the table frame in its set-up condition. The table top and table frame are separated from each other when the table is in its broken down or non-assembled condition.

Unlike the prior art collapsible table designs, the table structure of the present invention can be expanded to different sizes for use without compromising the size of the collapsed and bundled table. In addition, the table structure of the present invention can be expanded to multiple table sizes without affecting the stability of the set-up table. Still further, the table structure of the present invention utilizes a unitary table frame design that can be collapsed and bundled to a minimally-sized bundle without any components interfering with or affecting the collapsing process, or without any extra separate frame components that must be accounted for during set up, break down, storage and transportation of the table.

These and other objects, features and advantages of the present invention will become apparent in light of the detailed description of embodiments thereof, as illustrated in the accompanying drawings.

DESCRIPTION OF PREFERRED EMBODIMENTS

Figure 1:
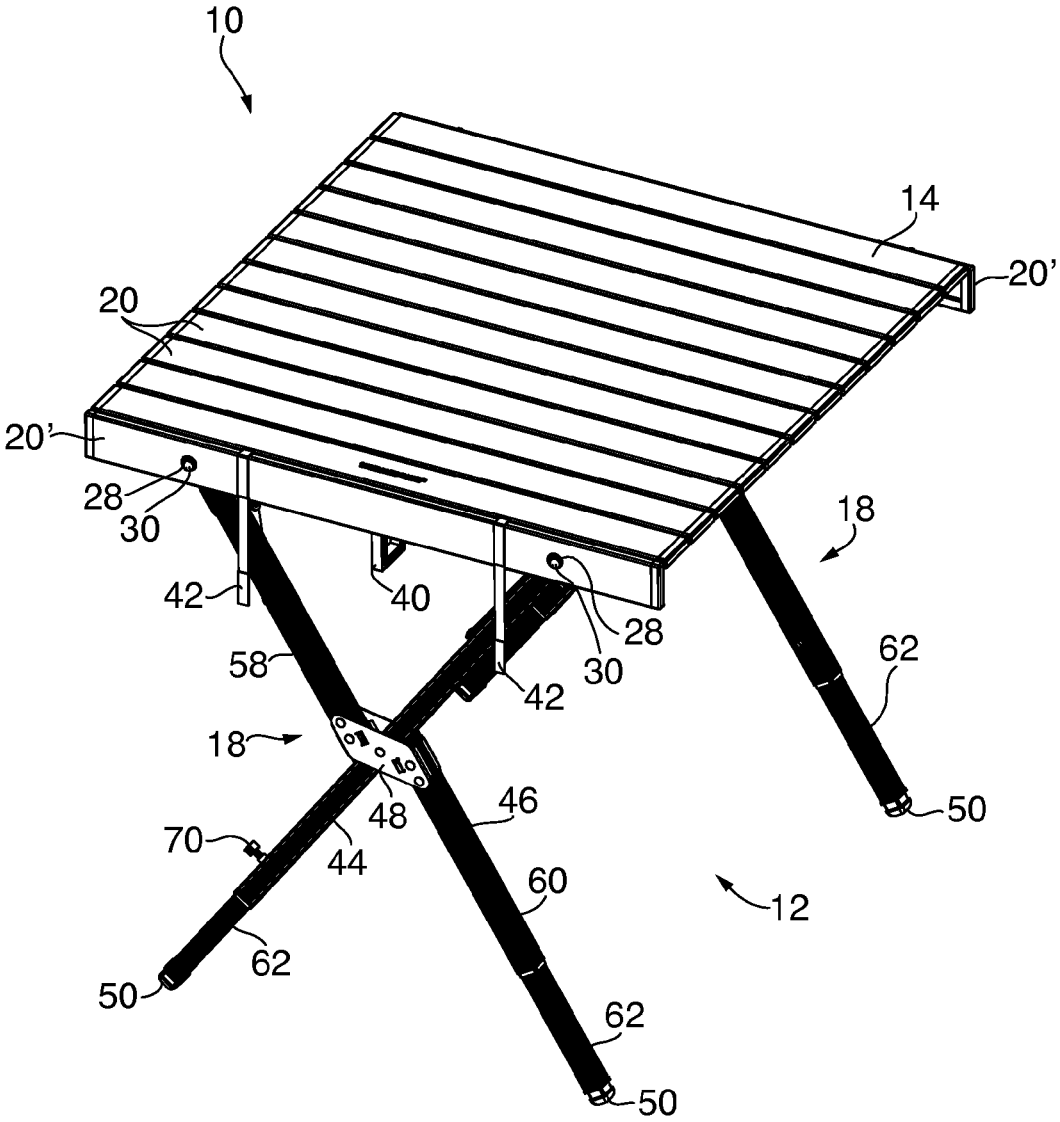
FIG. 1 is a perspective view of a set-up table structure embodying the present invention.

In the drawings and in the description that follows, the present invention is illustrated and described with reference to a portable and collapsible table structure embodying the present invention.

Figure 2:
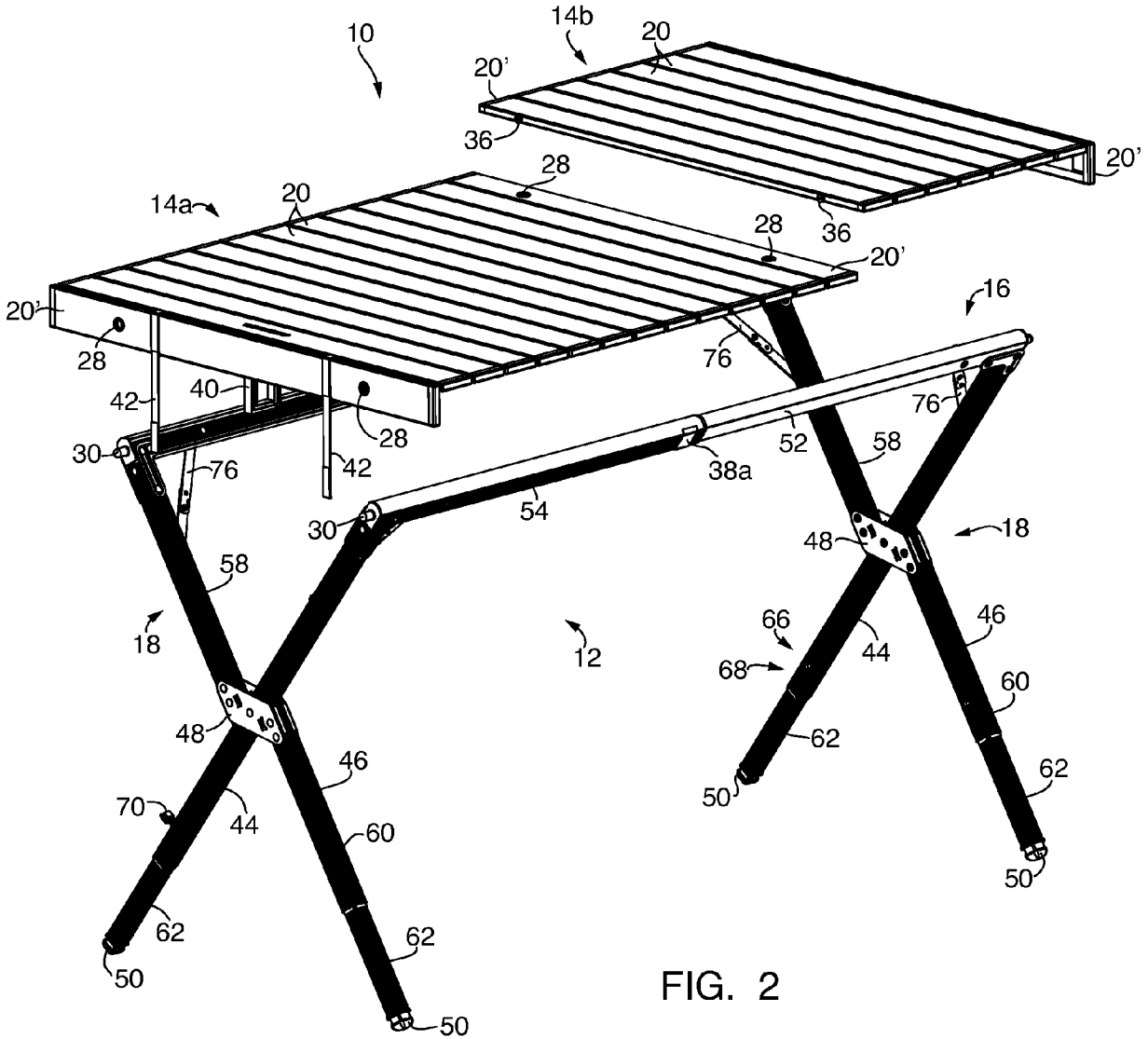
FIG. 2 is a partially exploded perspective view of the table structure of FIG. 1 in an extended set-up position.

Turning now to the drawings and referring first particularly to FIGS. 1-2, a collapsible two-legged table structure of cross-legged type embodying the present invention is designated generally by the reference number 10. The illustrated table 10 essentially comprises a collapsible supporting structure indicted generally at 12 which forms the base of the table 10 and supports a generally rectangular tabletop 14 in a horizontally disposed position when the table 10 is in its set-up or open condition and ready for use as it appears in FIG. 1. The supporting structure 12, shown more particularly in FIGS. 3-4, generally comprises a table frame 16 for supporting the tabletop 14, and a plurality of leg assemblies 18 mounted thereunder.

Figure 11:
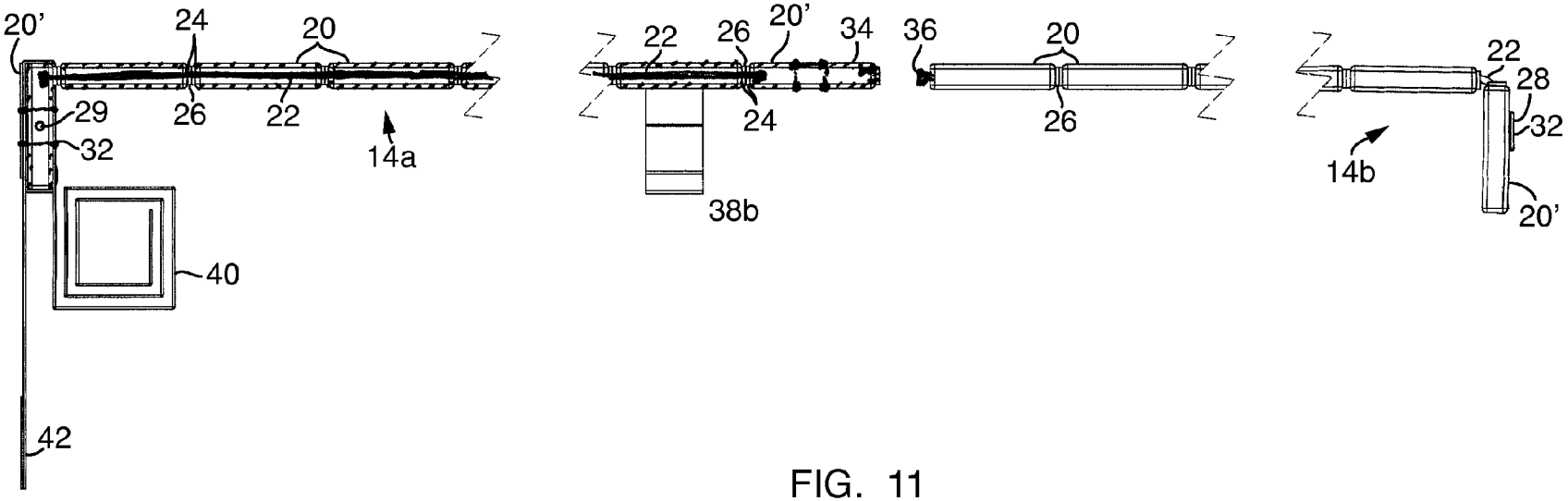
FIG. 11 is a side, partially cross-sectional view of tabletop sections used with the table of FIG. 1.
Figure 21:
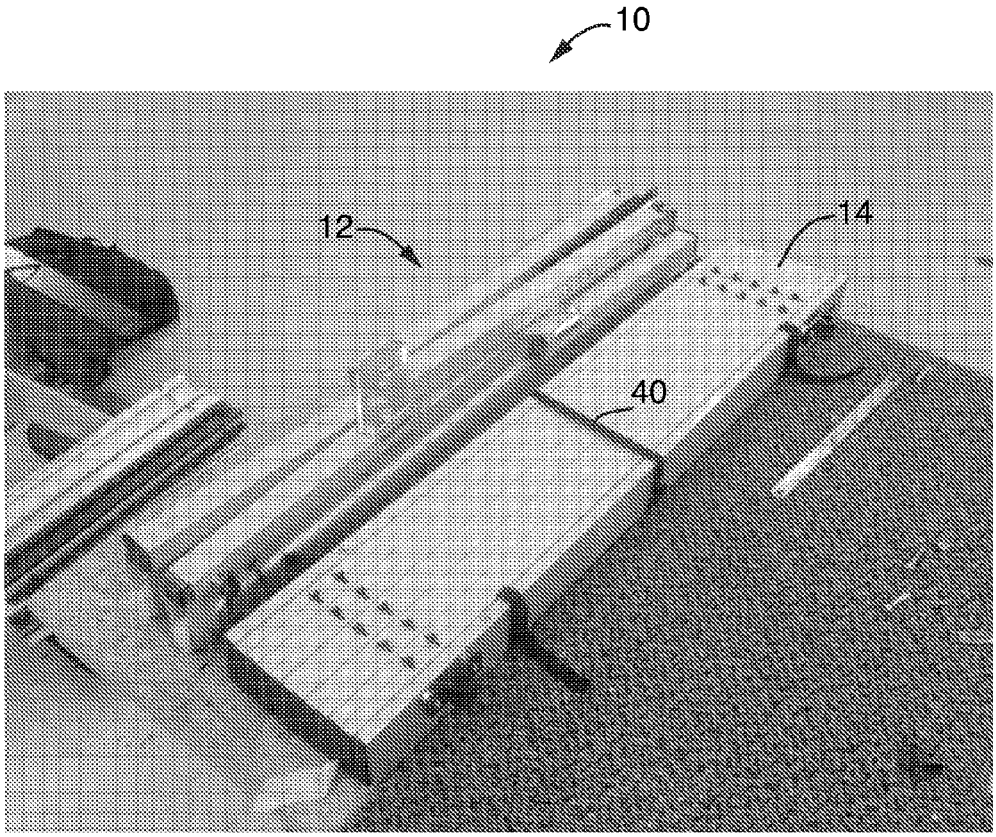
FIG. 21 is a perspective view of the table structure of FIG. 1 in a collapsed and bundled condition in accordance with the present invention.

In preferred designs of the present invention, the tabletop 14 is removable from the supporting structure 12, and may be independently collapsed to a smaller size for transport and storage, such as the version of the tabletop 14 shown in FIG. 21 in a compressed, folded condition. As shown in FIGS. 1-2, the tabletop 14 is of a roll-top type, generally comprising a plurality of substantially identical axially elongated tubular slats 20 of a rectangular cross-section that are maintained in side-by-side parallel relation to each other in set up condition to define a substantially planar upwardly facing table surface. As shown in FIG. 11, elastomeric cords 22 act between the end-most slats 20' of the tabletop 14, passing transversally through openings 24 formed in the sidewalls of the slats 20 to bias each of the slats 20 toward and into side-by-side relation to one another. When the tabletop 14 is removed from the supporting structure 12, it can be folded to a collapsed and bundled condition by alternately folding the slats 20 in zigzag fashion to form a compact bundle, as shown in FIG. 21. Each opening 24 is fitted with a grommet 26 to protect the elastomeric cords 22 from abrasion, especially during folding of the slats 20 to bundle the tabletop 14.

In the design illustrated in FIGS. 1-2, and shown more particularly in FIG. 11, at least one end-most slat 20' is preferably biased to a normal (i.e., 90 degree) relationship to the substantially planar table surface formed by the set-up tabletop 14. As so designed, the end-most slat 20' readily conforms to the table frame 16 in its set-up condition, as illustrated in FIG. 1. This end-most slat 20' also includes means for connecting the tabletop 14 to the table frame 16 to reduce shifting and separation of the tabletop 14 during use of the table 10. As illustrated, the connecting means include holes 28 formed in the end-most slat 20' that engage projections 30 provided on the table frame 16. Preferably, the engagement of the holes 28 with the projections 30 forms a snug fit between the tabletop 14 and the table frame 16 that prevents accidental disengagement of the tabletop 14 from the table frame 16 during use of the table 10. For example, elastomeric grommets 32 may be provided in the holes 28 to create a tight fit with the projections 30, which requires a bit of force from the user to disengage the tabletop 14 from the supporting structure 12. Typically, the connecting means work in combination with the elastomeric cords 22 extending between the tabletop slats 20 to bias the tabletop 14 onto and around the frame 16 and prevent accidental shifting or disengagement of the tabletop 14 during use of the table 10. Alternative connecting means may be used to hold the tabletop 14 in place without departing from the spirit and principles of the present invention, including but not limited to straps, hook-and-loop fasteners, various alternate slot/projection combinations, and the like.

In use, the tabletop 14 is unrolled and supported on top of the table's supporting structure 12. The table 10 may comprise one or more tabletop sections so as to be used with various sizes of the table 10, as adjusted in the manner described in more detail below. When multiple tabletop sections are used, for example, using section **14*a* and section 14*b*, as illustrated in FIG. 2, they are preferably connected together to prevent shifting or separation relative to one another when the table 10 is being used. As shown, the end-most slats 20' of each tabletop section are preferably designed to be biased into a 90 degree relationship with the substantially planar set-up tabletop surface so as to facilitate mounting of the tabletop 14 onto a set-up supporting structure 12. At least one such end-most slat 20' of each tabletop section—as shown, the end-most slats designed to end up in the middle of the set-up tabletop—is permitted to lay flat so that it is parallel and flush with the set-up tabletop surface. In this regard, the tabletop 14 is easily attached to an additional tabletop section without affecting the substantially planar tabletop surface desired for use of a set-up table 10. Thus, when the table 10 is extended to a larger table size in accordance with the present invention, two tabletop sections 14*a* and 14*b* can be joined together to cover the increased footprint of the table 10. As so disposed, the adjacent end-most slats 20' of the connected tabletop sections are connected together so as to form a larger interconnected tabletop. To improve the connection between the tabletop sections and as a result reduce shifting and separation of the tabletop sections relative to one another, complementary connecting means are provided on the ends of the end-most slats 20'. For example, as illustrated in FIG. 11, one end-most slat 20' can be provided with slots or openings 34, such as keyhole slots, designed to receive complementary projections or rivets 36, such as shoulder rivets, provided on the end-most slat 20'** of the adjacent tabletop section. Alternative complementary connecting means may be used without departing from the spirit and principles of the present invention, including but not limited to straps, hook-and-loop fasteners, and various slot/projection combinations, and the like.

When multiple tabletop sections are connected together and mounted to the supporting structure 12, then unified tabletop can be further secured to the table frame 16 by additional connection means located towards the longitudinal center of the table frame 16. For example, strips of complementary hook-and-loop fasteners **38*a* and 38*b* can be provided on both the table frame 16 and the tabletop 14**.

Each tabletop section may also be provided with a bundle strap 40 connected to at least one slat 20 for holding the tabletop bundle together when the tabletop 14 is separate from the supporting structure 12 and folding into its bundled condition, as shown in FIG. 21. Additional straps 42 can be provided on one of the end-most slats 20' for attaching a bag to the table 10, such as a trash bag or a storage tote.

Figure 3:
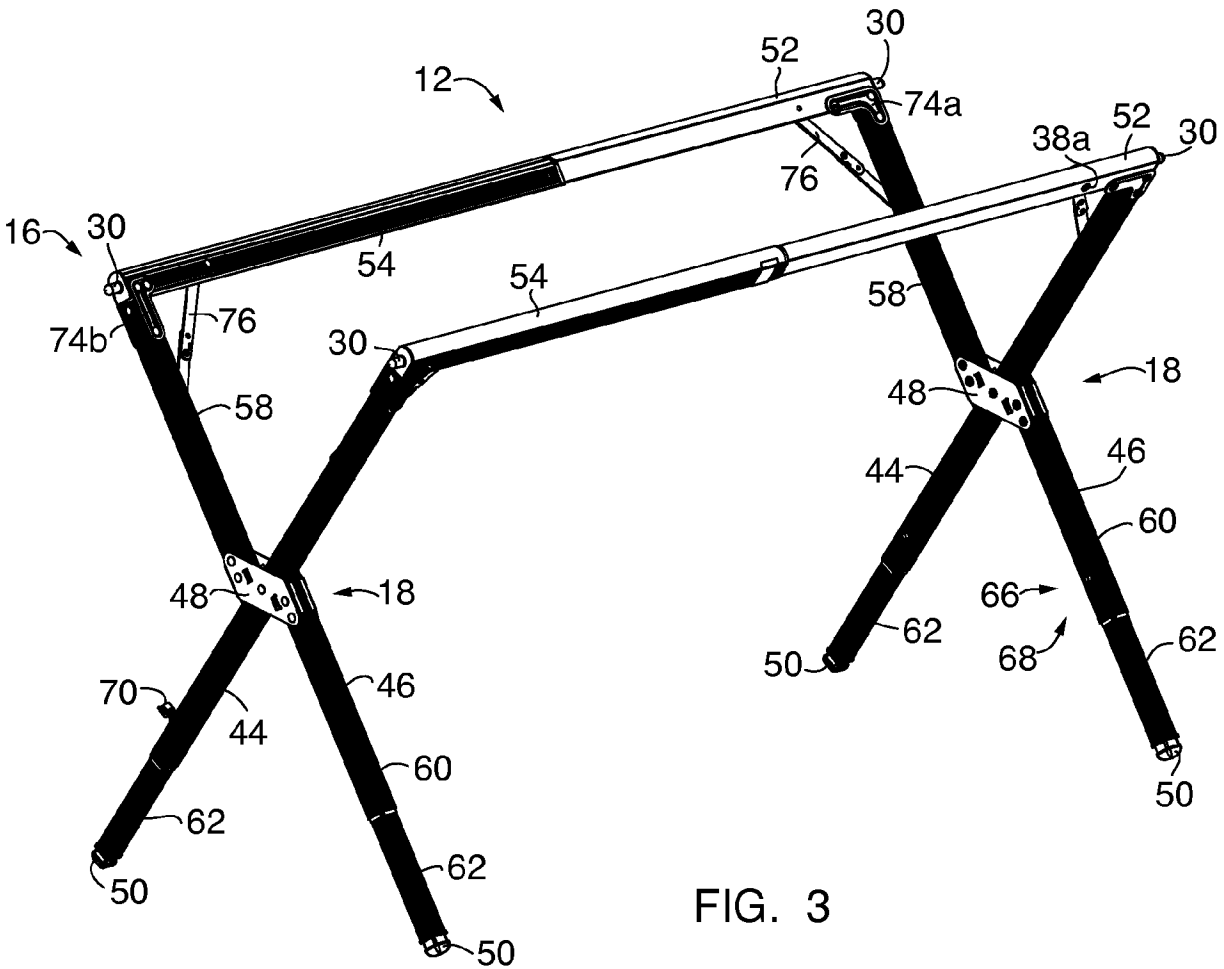
FIG. 3 is a perspective view of the supporting structure of the table of FIG. 2 in a longitudinally compressed set-up position.
Figure 4:
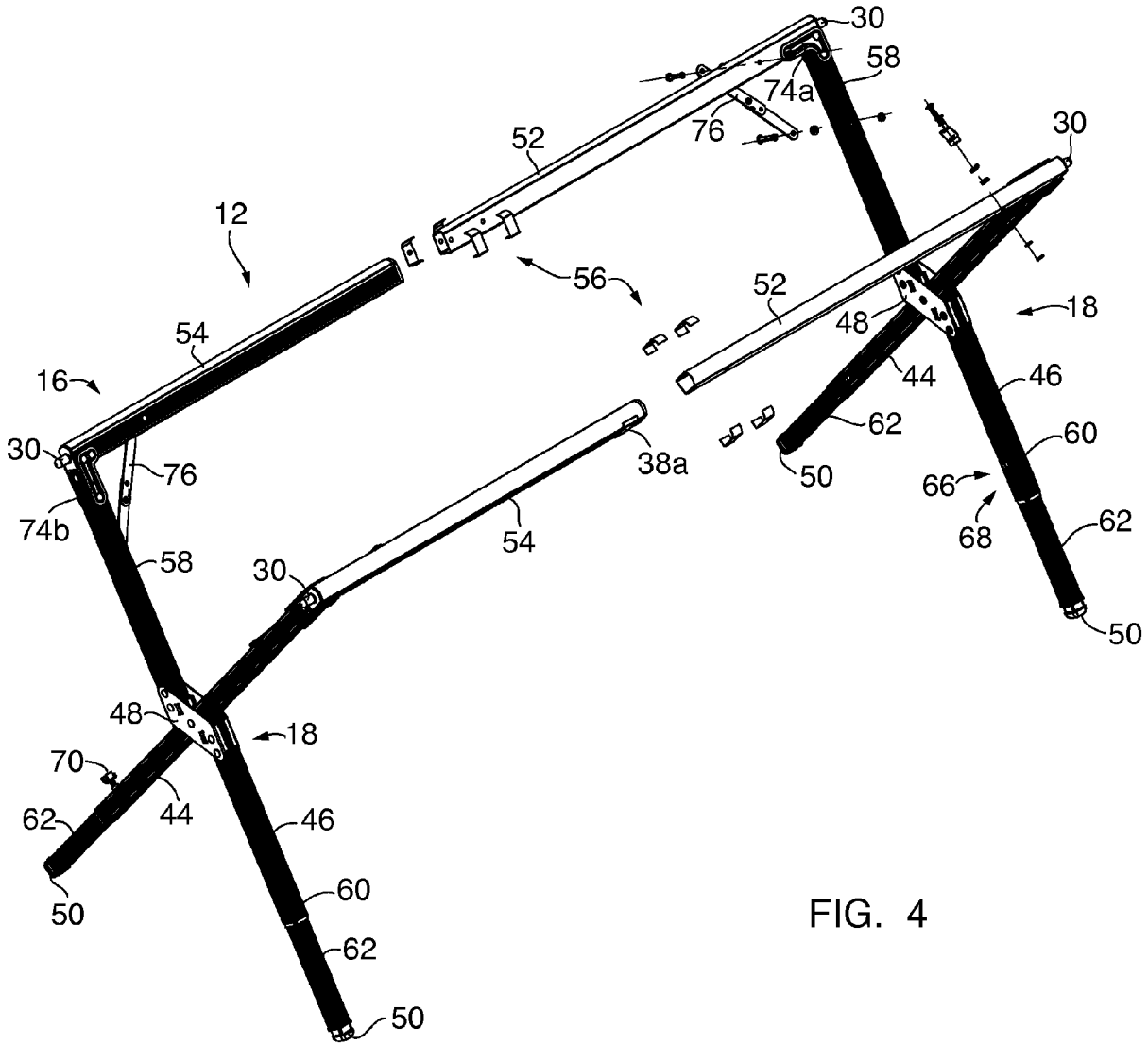
FIG. 4 is an exploded perspective view of the supporting structure of FIG. 2.
Figure 5:
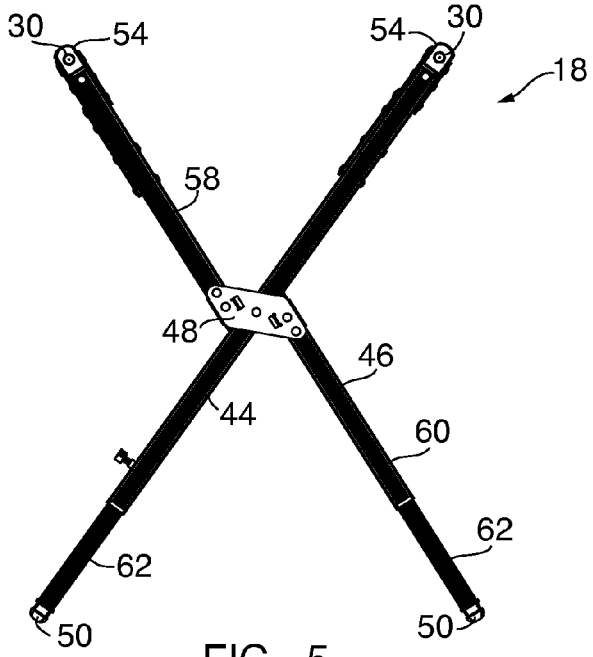
FIG. 5 is an end view of a leg assembly according to an embodiment of the present invention with the leg assembly in an open position with legs disposed in a generally X-shaped condition.
Figure 6:
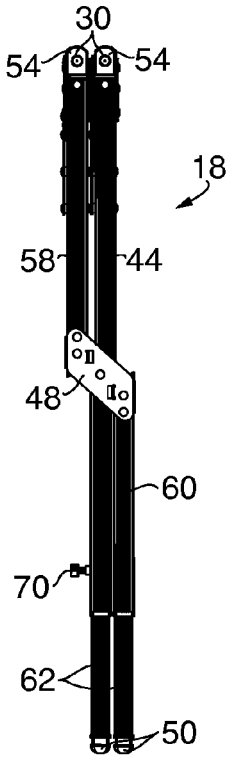
FIG. 6 is an end view of the leg assembly of FIG. 5 in a closed position with legs disposed in a generally parallel condition.

FIGS. 3-4 illustrate the supporting structure 12 without the tabletop 14 in place. As shown, there are preferably two leg assemblies 18, each of a cross-legged type, disposed on opposing ends of the table frame 16. As shown in FIGS. 5-6, each leg assembly 18 includes collapsible first and second legs 44 and 46 centrally connected, each to the other, by a common central linkage assembly 48 for limited angular movement about a pivot axis relative to each other between open and closed positions. Each leg 44 and 46 includes a foot 50 for engaging a generally horizontal support surface, such as a floor or the ground, and for keeping the table 10 generally stable in its set-up condition. In FIG. 5, the legs 44 and 46 are shown in the generally X-shaped open position. In FIG. 6, the legs 44 and 46 are shown in the closed position, with the leg components being disposed in generally parallel relation to one another. The illustrated leg assemblies 18 are merely preferred designs for the table structure in accordance with the present invention. Alternative designs of leg assemblies 18 can be used on the table structure without departing from the spirit and principles of the present invention, including, for example, the leg assemblies described in U.S. Pat. Nos. 8,056,969 and 7,828,377, which are incorporated herein by reference.

The illustrated table frame 16 comprises two longitudinally extending rails, each rail being expandable to differing lengths. As shown more particularly in FIG. 4, each rail comprises telescoping members, namely an inner rail member 52 and an outer rail member 54 that can be relatively adjusted to multiple predetermined lengths corresponding to desirable table sizes. For example, when the inner rail member 52 is disposed within the outer rail member 54 at the shortest frame length (see FIG. 3), the length of the set-up table 10 could be generally the same as the width of the set-up table 10, about 26 to 28 inches, essentially corresponding to a square table that could comfortably accommodate four people. By extending the inner rail member 52 from the outer rail member 54, the table frame 16 could be extended to, for example, a length of about 48 inches, which would correspond to an expanded rectangular table set-up that could comfortably accommodate six people (see FIG. 2). The rail members 52 and 54 could further be designed to be adjusted to any desirable lengths to correspond to a variety of set-up table sizes.

In a preferred embodiment of the table frame 16, the outer rail member 54 defines an interior cavity for receiving the inner rail member 52 wherein the interior cavity is not blocked by any structural components so that the inner rail member 52 can telescope within substantially the entire length of the outer rail member 54 to reduce the collapsed size of the table frame 16 for storage and transport. In this regard, the collapsed size of the table frame 16 can be reduced to a small dimension that generally could not be obtained in designs where structural components of the frame, such as connectors and pivot pins interfere with or otherwise affect telescoping movement of one member relative to another member.

It is desirable to ensure that the telescoping members of the table frame 16 are locked or otherwise maintains in place when the table 10 is set-up so as to avoid accidental or inadvertent collapsing of the table 10 during use. Accordingly, means may be provided to maintain the inner and outer rail members 52 and 54 in secure positions relative to each other at desired set-up lengths for the table frame 16. For example, the rail may be provided with spring-biased buttons that engage predefined buttonholes located along the rails at locations corresponding to at least at the smallest relative length of the table frame 16, which also coincides with the collapsed size of the supporting structure 12, and at least one expanded length of the table frame 16. Bushings 56 are also provided on the table frame 16 to provide a stop for when the rail members 52 and 54 are fully expanded. For example, at least one bushing 56 may be mounted to the end of the inner rail member 52 and another bushing or a stop (not shown) may be mounted to the inside wall of the outer rail member 54. The inner bushing 56 may freely slide within the outer rail member 54 when the inner rail member 52 is moved, but will limit further movement of the inner rail member 52 when it engages the outer bushing or stop.

Further considering the leg assemblies 18 of the supporting structure 12 and further referring particularly to FIGS. 5-6, the first and second legs 44 and 46 of each leg assembly 18 are connected to each other by the common central linkage assembly 48. In a preferred design of the leg assemblies 18 for the present invention, as shown, the first leg 44 is a continuous leg, while the second leg 46 is broken into an upper section 58 and a lower section 60. The first continuous leg 44 is pivotally connected to the common central linkage assembly 48, which takes the form of one or more pivot brackets, by a pivot pin. The upper and lower sections of the second leg are fixedly secured to the pivot brackets 48 by rivets. To open and set-up the leg assembly 18, the first continuous leg 44 pivots until it is restrained from movement by the upper and lower sections 58 and 60 of the second leg 46 and/or by the pivot brackets 48. In this open condition (FIG. 5), the first and second legs 44 and 46 form a generally X-shaped leg assembly 18. To close the leg assembly, the first continuous leg 44 pivots until it is generally parallel with the upper and lower sections 58 and 60 of the second leg 46, with the upper section 58 being disposed on one side of the first leg 44 and the lower section 60 being disposed on the other side, as shown in FIG. 6.

Figure 7:
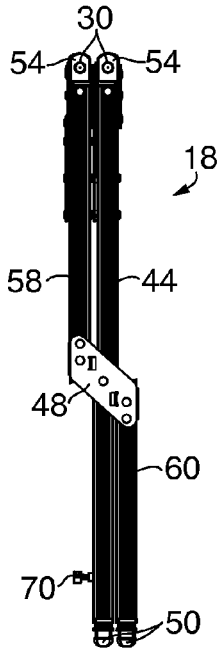
FIG. 7 provides an end view of the leg assembly of FIG. 5 showing the retraction of inner telescoping members of the legs.

Each of the first and second legs 44 and 46 are further designed to be extendable to longer lengths. For example, FIG. 6 illustrates the leg assembly 18 with the legs 44 and 46 extended to a desired length for use of the table 10. By comparison, FIG. 7 illustrates the leg assembly 18 with the legs 44 and 46 retracted to a shorter length. The shorter leg length of the leg assembly 18 is conducive to collapsing and bundling the supporting structure 12 to a minimally-sized bundle in accordance with the present invention.

Figure 8:
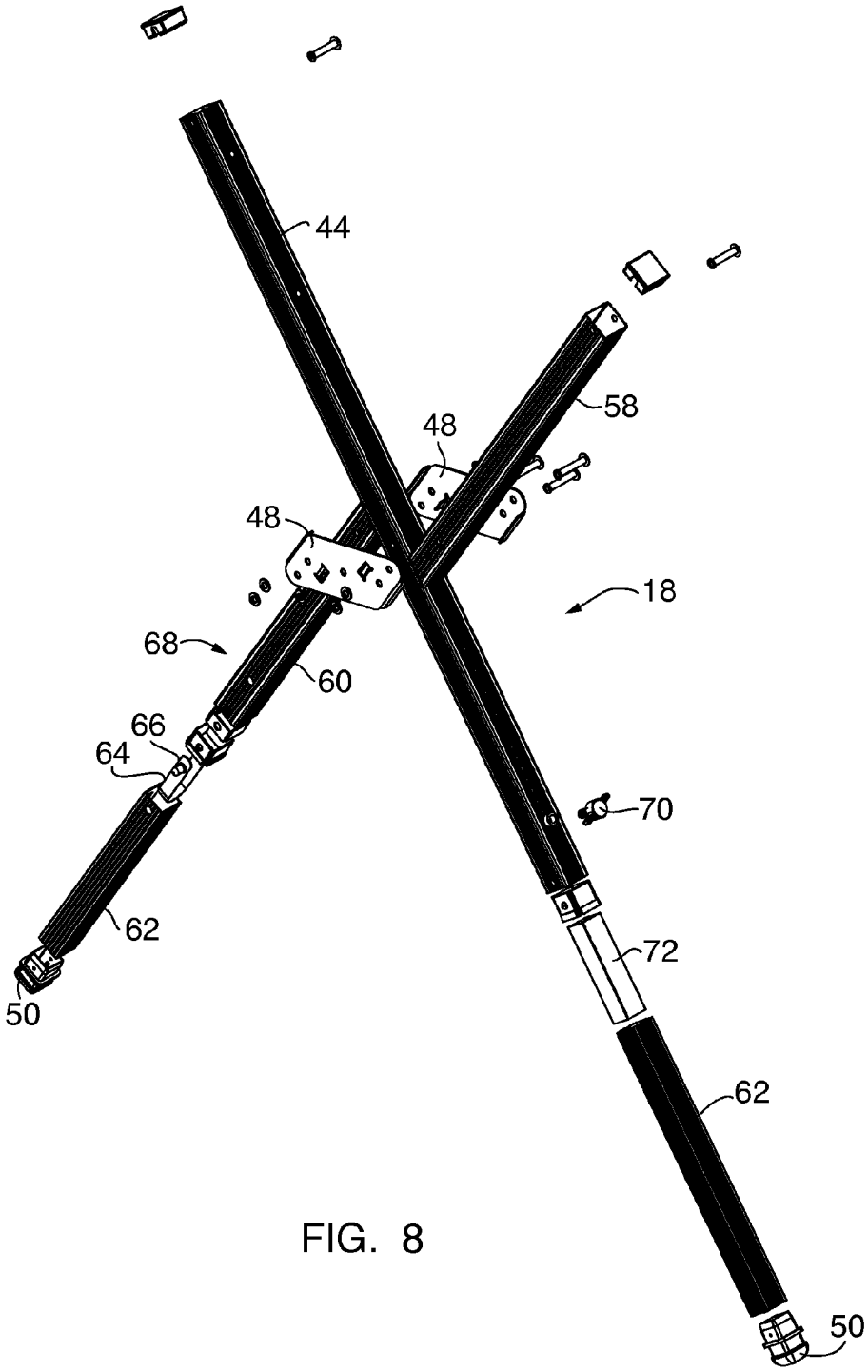
FIG. 8 is an exploded perspective view of the leg assembly of FIG. 5 showing inner telescoping leg members according to an embodiment of the present invention.

In a preferred design, each leg 44 and 46 includes a telescoping inner leg member 62, as shown in FIG. 8, that can be extended from the bottom of the leg and locked into place at a desired length. Locking means, such as a leaf spring button configuration comprising a leaf spring 64 with a button 66 extending therefrom, preferably lock the telescoping members 62 into place. For example, the lower portion of the first leg 44 and the lower section 60 of the second leg 46 on each leg assembly 18 may be provided with one or more buttonholes 68. The leaf spring 64 is disposed within the telescoping member 62 with the button 66 projecting out therefrom for engagement with the buttonholes 68 of a corresponding leg member 44 or 46. No bushings or stops are required between the inner telescoping members 62 and the outer legs 44 or 46. Preferably, the buttons 66 are positioned to project from the inside of each leg 44 and 46, that is, facing under the table 10.

One buttonhole can be provided near the pivot bracket 48 to maintain the telescoping member 62 in place when in an uppermost, or retracted, position. For example, FIG. 7 shows the telescoping members 62 fully retracted into the first and second legs 44 and 46, with the buttons 66 for each member engaging a respective upper buttonhole 68. This buttonhole may be slightly smaller than the other buttonholes provided on the legs to permit easier release of the telescoping member 62 for set-up of the table 10.

Other buttonholes 68 formed in the first and second legs 44 and 46 can be located to correspond to desirable lengths of the legs 44 and 46, which will further correspond to the height of the set-up table 10. The set-up buttonholes 68 allow the spring-biased button 66 on the telescoping member 62 to pop through the buttonhole 68 upon engagement, which will lock the telescoping member 62 into position at the selected length for the leg 44 or 46. FIG. 6 illustrates each leg 44 and 46 with the inner telescoping member 62 fully extended. As shown, only one lower buttonhole is provided in the legs, though additional buttonholes can be provided without departing from the spirit of the present invention, so as to allow for various table heights.

To collapse the legs 44 and 46 to fold up the supporting structure 12, the buttons 66 are pushed through the buttonholes 68 so that the telescoping members 62 can be retracted within the legs 44 and 46 until the button 66 engages the uppermost buttonhole 68. The legs 44 and 46 must be completely collapsed in this manner to achieve the most compact folded condition for the supporting structure 12.

Retraction of the telescoping leg members 62 helps reduce the size of the bundled supporting structure 12. The standard height for portable tables is about 33 inches. Accounting for the size of the tabletop and any table frame, standard length of legs for such tables are between about 28 and 32 inches. Where such legs are fixed in length, the corresponding size of the collapsed bundle is limited to the length of the legs. By reducing the size of the legs, such as by telescoping a portion of each leg to a retracted position, the size of the end bundle for the table can be likewise reduced, thereby improving portability and storage of the table structure. In the present invention, the size of the compressed table frame 16 can be coordinated with the size of the leg assemblies 18 reduced in the manner described above. As illustrated in FIG. 21, the reduced length of the leg assemblies 18 generally corresponds to or is smaller than the compressed size of the table frame 16, with the inner rail member 52 fully telescoped within the outer rail member 54 and the length of the leg assemblies 18 shortened by retracting a portion of each leg 44 and 46.

One of the legs on the supporting structure 12 may be provided with an alternate means of adjustment and locking in order to provide leveling capability for the table 10. With the leaf spring button configuration described above, the inner telescoping member 62 is locked at predetermined positions. However, the table 10 of the present invention is designed for use in a variety of settings, including at campgrounds, beaches and fields, where the ground may be uneven. The table 10 can be leveled by providing at least one leg with a greater degree of adjustability. For example, FIG. 8 illustrate a "leveling" leg with a thumbscrew 70 that can be tightened to engage the inner telescoping member 62, or more particularly, a leg insert 72, and loosened to permit movement and adjustment of the telescoping member 62. The thumbscrew 70 or a similar means for adjusting and locking the telescoping member 62 permits finer adjustment of the telescoping member 62, and as a result, replaces the spring-biased button and buttonhole combination described above for the "leveling" leg. Because this "leveling" leg needs to have slightly more adjustment range than the other legs, and indeed may require the length of the extended leg to be longer than the others, it is preferable to provide such adjustment means on a first continuous leg 44 of at least one of the leg assemblies 18. In this way, the "leveling" leg can accommodate any required adjustments with being limited by the length of the inner telescoping member or without interfering with the common central linkage assembly (e.g., bracket rivets attaching the lower section 60 of the second leg 46 to the pivot bracket 48, which are not required for the first continuous leg 44, as shown in FIG. 5).

Figure 9:
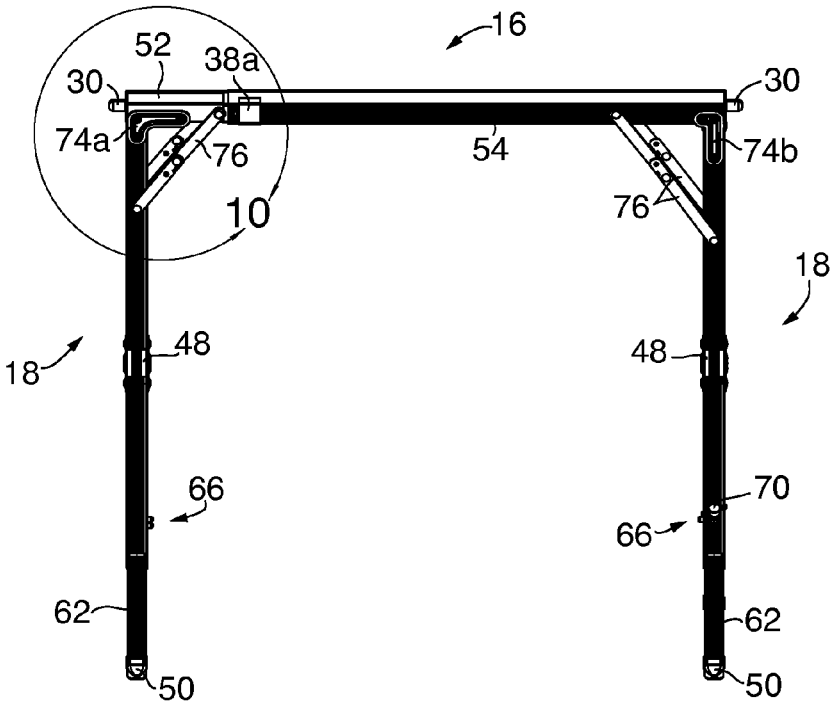
FIG. 9 is a side view of the supporting structure of FIG. 3 with the leg assemblies in a closed condition.

In the set-up condition, the supporting structure 12 takes the form generally shown in FIGS. 2-3. FIG. 2 corresponds to the supporting structure 12 in an expanded set-up, that is, with the table frame 16 longitudinally extended. By comparison, FIG. 3 shows the supporting structure its shortest lengthwise set-up, corresponding to a generally square set up table size, as well as the fully compressed condition of the rail members 52 and 54, which is ideal for collapsing the supporting structure to a minimally-sized bundle in accordance with the present invention. FIG. 9 also shows the supporting structure 12 in this fully compressed condition, with the inner rail member 52 fully telescoped within the interior cavity of the outer rail member 54 without any internal interference from any structural components of the supporting structure 12.

As shown in FIG. 9, the leg assemblies 18 are connected to the table frame 16 by generally L-shaped connecting elbows 74. The elbows on a first end of the table frame 16 are short elbows 74*a*, while the elbows on a second end of the table frame 16 are long elbows 74*b*, i.e., the leg of the generally L-shaped elbow projecting down the leg assembly 18 is longer. The design and positioning of the elbows 74 on the table frame 16 allows maximum telescoping action of the table frame 16 so as to reduce the length of the collapsed supporting structure 12 and ensure a compact bundle for easy transport and storage. The other end of each elbow 74 is rigidly secured to the upper end of a corresponding leg 44 or 46. When collapsing the supporting structure 12, the elbows 74, and thus the leg assemblies 18, rotate inwardly and under the table frame 16 in alternating fashion, as indicated by arrows A and B in FIGS. 12 and 13. As so folded, the table frame 16 and each collapsed leg assembly 18 are disposed in generally parallel relationship, providing a reduced bundled size for the broken down table 10.

Figure 10:
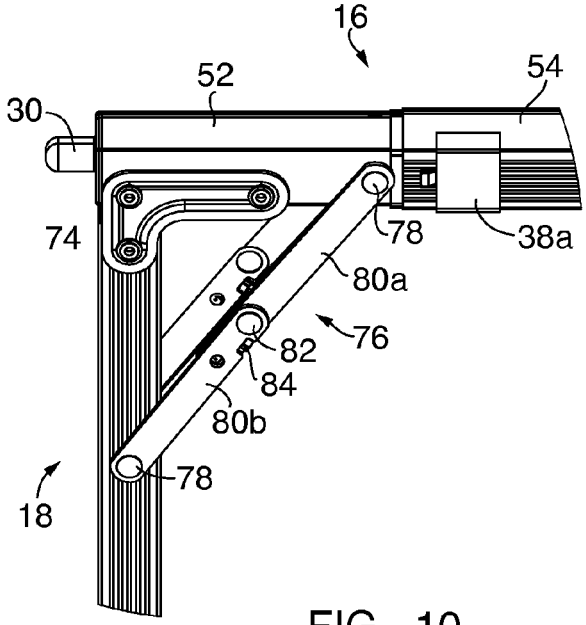
FIG. 10 is an illustration of a pivotal elbow connection between a leg assembly and a table frame in accordance with the present invention.

The elbows 74 are pivotally connected on one end to the table frame 16 at a position located proximate to the end of the table frame rails 52 and 54. To reduce the compressed size of the table frame 16 and the collapsed size of the table 10, the long elbows 74*b* are preferably attached to the outer rail member 54 so that the rivets attaching the elbow to the rail do not interfere with telescoping movement of the inner rail member 52 within the outer rail member 54. As a result, the short elbows 74*a* are attached to the end of the inner rail members 52, as shown in FIG. 10. The leg assemblies 18, when folded out from the table frame 16, are preferably located at the ends of the frame 16, as shown in FIG. 9.

As further shown in FIG. 9, each leg 44 and 46 is also connected to the table frame 16 by a locking member 76, which may take the form of a conventional over-the-center linkage, shown more particularly in FIG. 10. In a preferred embodiment, a locking member 76 is affixed between each leg 44 or 46 and the table frame 16 so as to minimize the complexity of setting up and breaking down the supporting structure 12. That is, the locking member 76 stays attached to both the frame 16 and an associated leg 44 or 46, preferably by rivets 78, even when the leg is moving in relation to the frame 16, or when the frame 16 is being adjusted to increase or decrease the table size. Such a locking member 76 generally comprises two portions 80*a* and 80*b* that are connected via a central pivot pin 82 that permits the locking member 76 to be folded, for example, when the leg assembly 18 is being folded relative to the table frame 16. The central portion of the locking member 76 also may include a locking boss and recess combination 82 for locking the linkage into a straight condition. Such a locking boss and recess combination 82 prevents unintentional or accidental folding of the leg assembly 18 and typically requires a concerted force to unlock the locking member 76 so as to permit the leg assembly 18 to be folded relative to the table frame 16. In this regard, the over-the-center linkage of the locking member 76 can be locked in place when the leg assembly 18 is fully extended relative to the table frame 16 in the set-up condition of the table 10, and can be unlocked and folded with movement of a leg assembly 18 to permit collapsing of the leg assembly 18 relative to the table frame 16.

In accordance with a preferred design of the present invention, a locking member 76 is permanently attached between a leg and the outer rail member 54. So as to eliminate any potential interference created by this attachment to the telescoping of the inner rail member 52 within the outer rail member 54, the attachment of the locking member 76 is achieved by a short rivet connection provided on a rivet boss projecting outwardly from the outer rail member 54. As a result, the interior cavity of the outer rail member is free from any attachment components, and the inner rail member 52 can freely telescope within the outer rail member 54 so as to permit a shorter compression length of the table frame 16.

Figure 14:
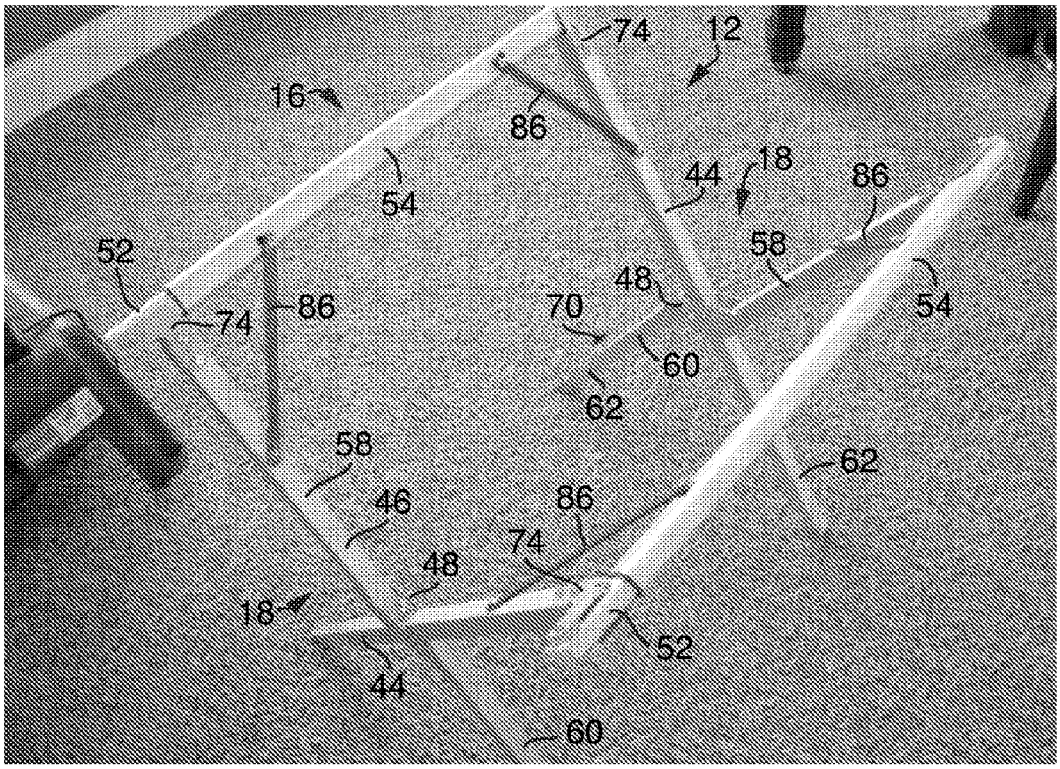
FIG. 14 is a perspective view of an alternate embodiment of a supporting structure of a table structure embodying the present invention in a longitudinally compressed set-up position.
Figure 15:
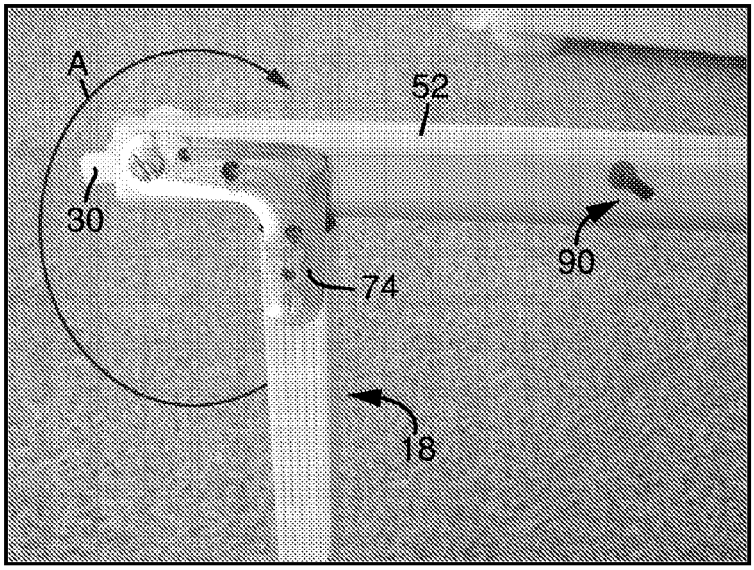
FIG. 15 is an illustration of a pivotal elbow connection between a leg assembly and a table frame used in the supporting structure of FIG. 14 in accordance with the present invention.

In an alternate embodiment of the table frame 14, illustrated in FIG. 14, the connecting elbows 74 are mounted in "reverse" position, as shown more particularly in FIG. 15, and are pivotally connected on one end to the table frame 16 at a position located proximate to, but slightly longitudinally offset from, the end of the table frame rail members 52 and 54. With such a design, when collapsing the supporting structure 12, the elbows 74, and thus the leg assemblies 18, rotate outwardly and over the top of the table frame 16 along the general path indicated by arrows A and B in FIGS. 15, 17 and 19. As so folded, the table frame 16 and each collapsed leg assembly 18 are disposed in generally parallel relationship, providing a reduced bundle size.

Figure 16A:
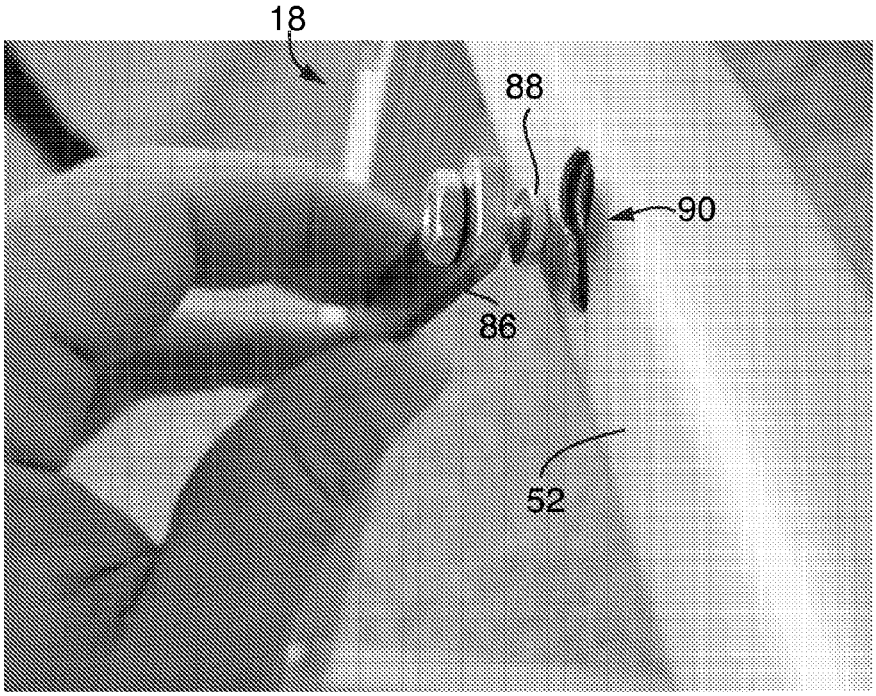
FIG. 16A is a perspective view of a support link in accordance with an embodiment of the present invention.
Figure 16B:
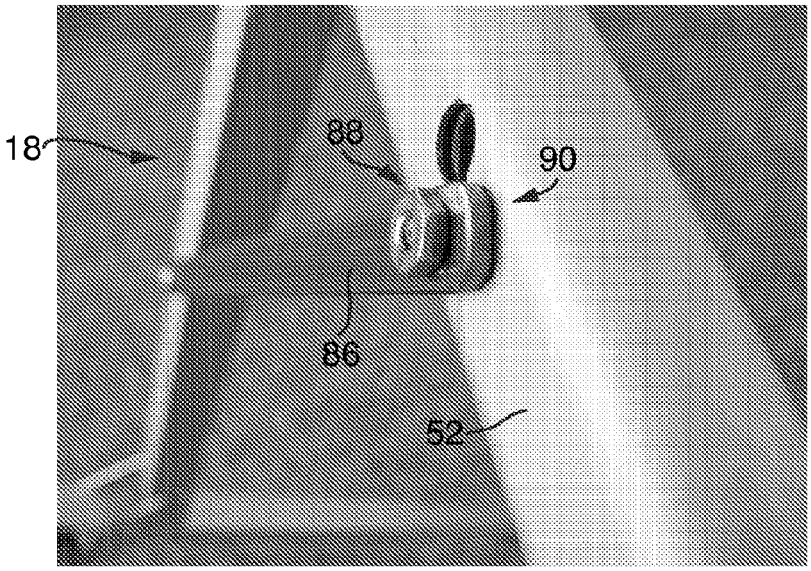
FIG. 16B is a perspective view of the support link of FIG. 16A in a locked position.

In such an alternate embodiment, since the elbows 74 and leg assemblies 18 rotate outwardly and over the top of the table frame 16 during break down of the supporting structure 12, conventional folding links or locking members found on conventional folding tables cannot be used. Instead, the present invention may utilize detachable links 86, as shown in FIGS. 16A-16B, connected between each leg 44 or 46 and the table frame 16 to provide rigid locking means to secure the table 10 in the set-up condition when the leg assemblies 18 are in the open position. Since the links 86 are detachable, they can easily be disengaged from the table frame 16, the legs 44 or 46, or both during break down of the supporting structure 12. As shown, the links 86 are pivotally connected to the legs 44 and 46 and disengaged from the table frame 16 so as to not interfere with the break down operation.

As shown in FIGS. 16A-16B, the links 86 are locked into the table frame 16 using a shoulder rivet 88 attached at the end of each link 86. The head of the shoulder rivet 88 protrudes inwardly from the link 86 and can be pushed into a keyhole slot 90 formed in the table frame 16. The keyhole slot 90 can be angled away from the leg location. To secure the link 86 in place, the shoulder rivet 88 is slotted into the bulb portion of the keyhole slot 90 and rotated downwardly into the narrow slot portion of the keyhole slot 90. Generally, the keyhole slot 90 is geometrically shaped and positioned on the same arc created by the pivotal movement of the detachable locking link 86. The link 86 in a locked position is shown in FIG. 16B.

Keyhole slots 90 are provided in each of the table rail members 52 and 54 in at least four positions, two in the outer rail member 54 and two in the inner rail member 52. In the largest expanded condition of the supporting structure 12, the outermost keyhole slots 90 are used to receive the detachable locking links 86. In the shortest condition of the supporting structure 12, the keyhole slots 90 of the inner rail members 52 align with the keyhole slots 90 of the outer rail members 54 so as to not interfere with insertion of the shoulder rivet 88 into the keyhole slot 90. Of course additional keyhole slots 90 can be provided on the rail members 52 and 54 to correspond to additional set-up sizes of the supporting structure 12 in accordance with spirit and principles the present invention.

When the detachable locking links 86 are disengaged from the table frame 16, such as for break down of the supporting structure 12, the links 86 are rotated downward in alignment with the upper portion of each leg 44 and 46. Preferably, the pivotal mounting connections for the links 86 on the first and second legs 44 and 46 of each leg assembly 18 are offset so as to avoid interference when the leg assembly 18 is folded to the closed condition. Additionally, a punched hole may be provided in each leg to accommodate the shoulder rivet 88 when the links 86 are rotated to a folded condition in line with the legs 44 and 46. As so disposed, the links 86 can be kept flush with the legs 44 and 46 so as to not interfere with folding of the legs 44 and 46 to a closed condition.

Figure 12:
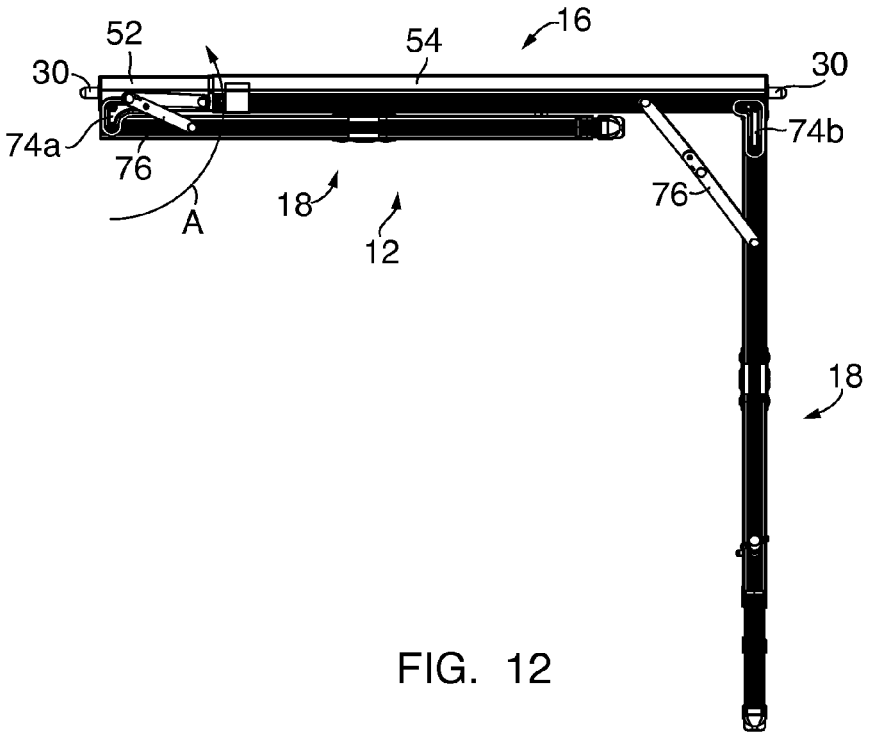
FIG. 12 is a side view of the supporting structure of FIG. 3 in a partially collapsed condition.
Figure 13:
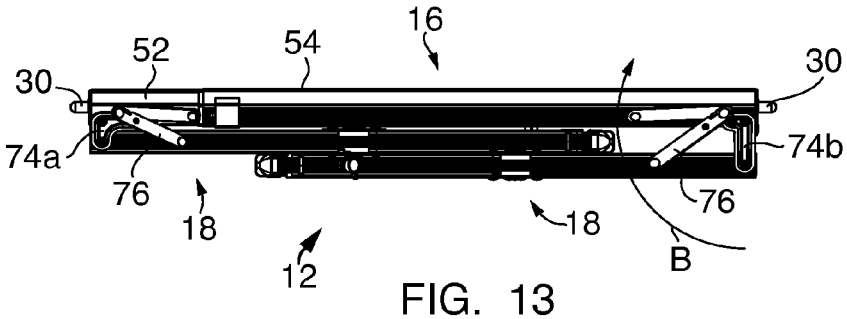
FIG. 13 is a side view of the partially collapsed supporting structure of FIG. 12 in a fully collapsed condition.

Referring to FIGS. 9 and 12-13, folding of a preferred design of the supporting structure 12 is illustrated. If the supporting structure 12 is in an expanded lengthwise condition, such as shown in FIG. 2, the user must first compress the table frame 16 so that the inner rail members 52 telescope into the outer rail members 54 as far as they can be compressed. Once the table frame 16 has been fully compressed, as shown in FIG. 9, the leg assemblies 18 may be folded to the closed condition, as shown from an end view in FIG. 6, and the telescoping leg members 62 are retracted to reduce the leg assemblies 18 to their smallest length, as shown from an end view in FIG. 7. As discussed above, the telescoping leg members 62 are preferably retracted by disengaging the lower leg buttons 66, and retracting the telescoping members 62 into the first and second legs 44 and 46.

The user may then fold the closed leg assembly 18 attached to the table frame 16 with the short elbow 74*a* inwardly and under the frame 16 until the leg assembly 18 is generally parallelly disposed along the bottom of the table rail members, as shown in FIG. 12. The user then folds the closed leg assembly 18 attached to the table frame 16 with the long elbows 74*b* inwardly and under the table frame 16 until the leg assembly 18 is generally parallelly disposed along the bottom of the first folded leg assembly, as shown in FIG. 13. The supporting structure 12 has been fully collapsed into a compact bundle. To set up the supporting structure 12, the above-described steps can be reversed.

Referring now to FIGS. 17-20, folding of an alternate design of the supporting structure 12 is illustrated. If the supporting structure 12 is in an expanded lengthwise condition, the user must first disengage the detachable locking links 86 from the table rail members 52 and 54 and rotate them to folded positions flush with respective legs 44 and 46. The user will next compress the table frame 16 so that the inner rail members 52 telescope into the outer rail members 54 as far as they can be compressed, such as shown in FIG. 14. Once the table frame 16 has been fully compressed, the leg assemblies 18 are folded to the closed condition, as shown from an end view in FIG. 6.

Figure 17:
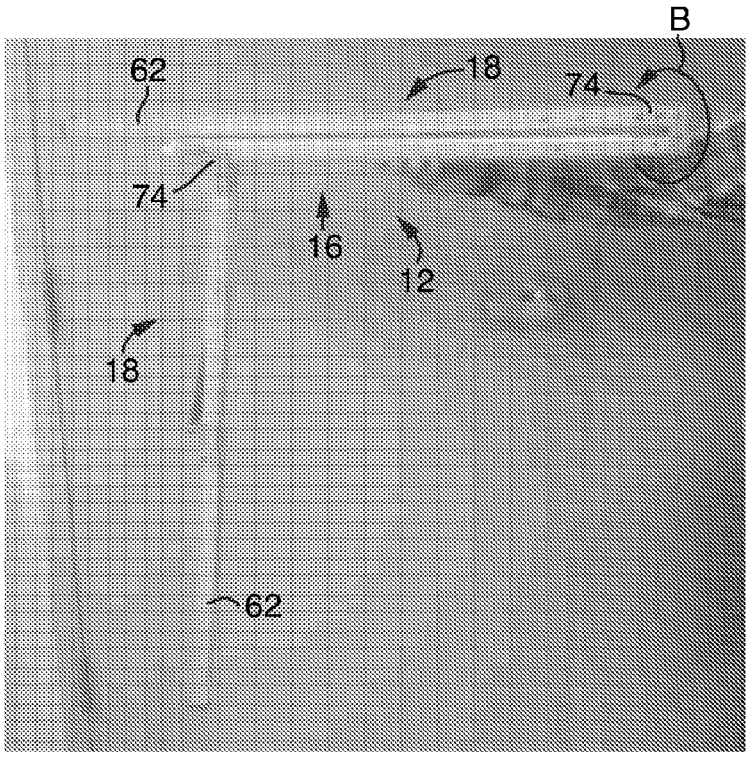
FIG. 17 is a side view of the supporting structure of FIG. 14 in a partially collapsed condition.
Figure 18:
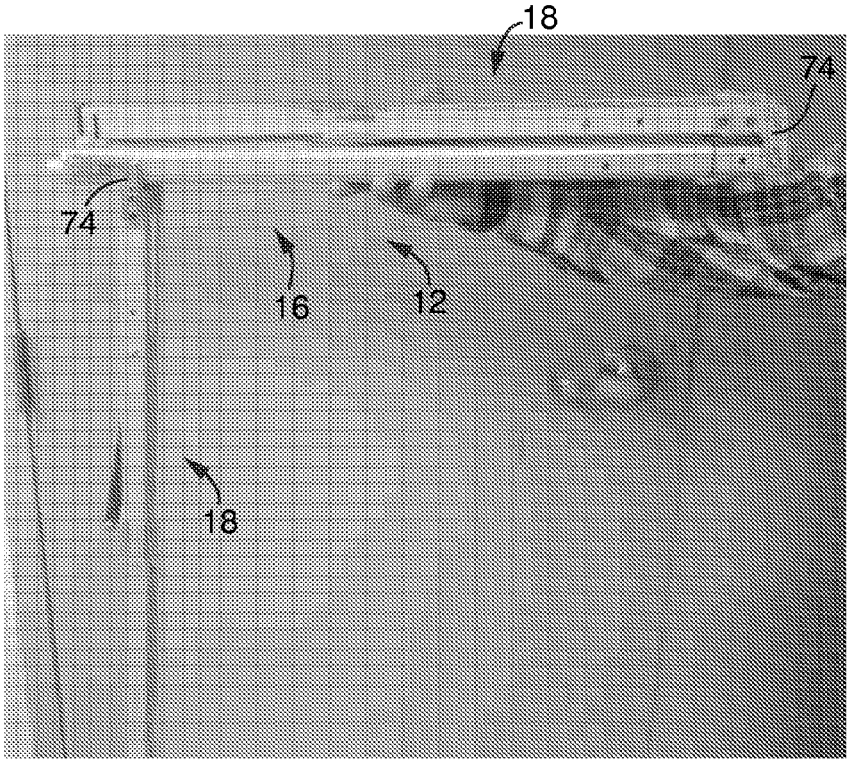
FIG. 18 is a side view of the partially collapsed supporting structure of FIG. 17 in a further partially collapsed condition.

The user may then fold the closed leg assembly 18 attached to the table frame 16 with the short elbows 74*a* outwardly and over the top until the leg assembly 18 is generally parallelly disposed along the top of the table rail members. In this alternate design of the table structure, the inner telescoping leg members 62 may still be extending out beyond the table rails, as shown in FIG. 17. The user can disengage the lower leg buttons 66 and retract the telescoping members 62 back into the first and second legs 44 and 46, as shown in FIG. 18, as part of the folding process, or can retract the telescoping leg members 62 prior to collapsing the table frame 16.

Figure 19:
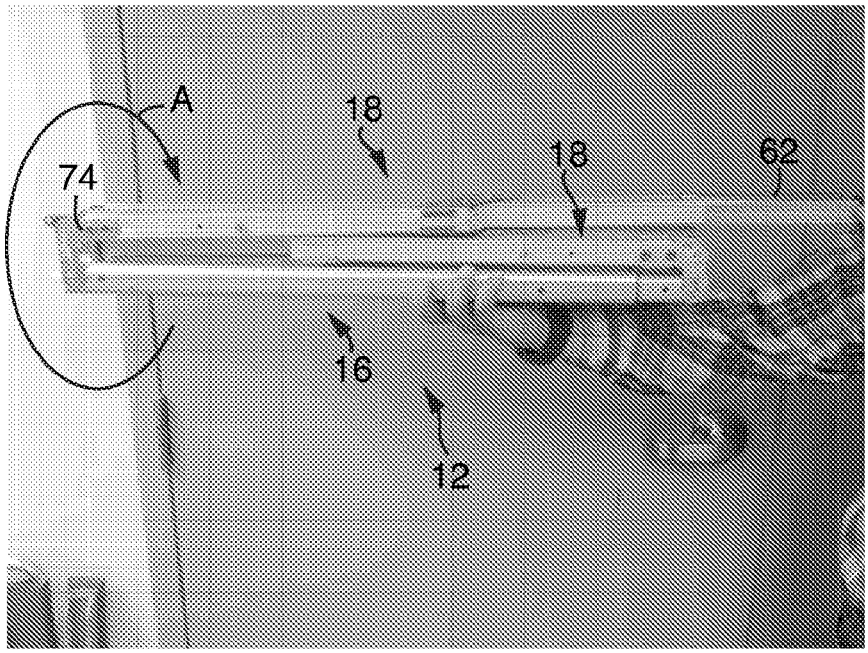
FIG. 19 is a side view of the partially collapsed supporting structure of FIG. 18 in a still further partially collapsed condition.
Figure 20:
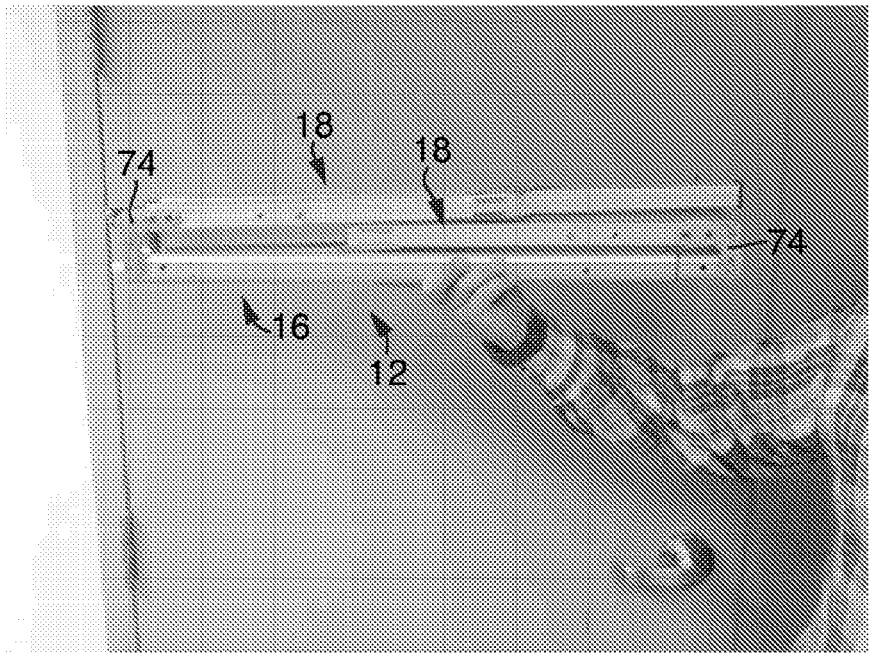
FIG. 20 is a side view of the partially collapsed supporting structure of FIG. 19 in a fully collapsed condition.

Next, the user folds the closed leg assembly 18 attached to the table frame 16 with the long elbows 74*b* outwardly and over the top until the leg assembly 18 is generally parallelly disposed along the top of the first folded leg assembly 18. Again, the inner telescoping leg members 62 may still be extending out beyond the table rails, as shown in FIG. 19. In this situation, the user can disengage the lower leg buttons 66 and retract the telescoping members 62 back into the first and second legs 44 and 46, as shown in FIG. 20. The supporting structure 12 has been fully collapsed into a compact bundle. To set up the supporting structure 12, the above-described steps can be reversed.

A fully collapsed table 10 is shown in FIG. 21. Specifically, the supporting structure 12 is fully collapsed, telescoped and folded into a collapsed condition. Likewise, the tabletop 14 is folded to a smallest compressed condition. The fully collapsed condition of the supporting structure 12 can be the same length as or smaller in length than the tabletop 14, which typically corresponds to the usable width of the set-up table, to provide the most efficient packing, storage and transport condition for the table 10.

The foregoing description of embodiments of the invention has been presented for the purpose of illustration and description. It is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular use contemplated.

What is claimed is:

1. A portable and collapsible table comprising:

a tabletop; and a supporting structure comprising:

a table frame comprising a pair of parallelly disposed telescoping rail members, wherein each rail member comprises an outer rail member and an inner rail member disposed within the outer rail member for telescoping movement relative thereto such that said table frame is adjustable to varying longitudinal sizes; and at least two leg assemblies each being pivotally connected to the table frame, wherein each leg assembly comprises a first leg and a second leg pivotally connected together, said leg assembly being movable between an open position and a closed position wherein in said open position, the first and second legs being disposed in a generally X-shaped condition, and wherein in said closed position, the first and second legs being disposed in a generally parallel condition;

wherein said tabletop and said supporting structure are collapsible to a portable condition.

2. The table according to claim 1, wherein the outer rail member defines an interior cavity substantially extending the entire length of the outer rail member that is not blocked by any structural components of the table along the length of the outer rail member such that the inner rail member may be telescoped within the interior cavity along substantially the entire length of the interior cavity.

3. The table according to claim 1, wherein each of the first and second legs is extendable so as to adjust the length of each said leg.

4. The table according to claim 3, wherein each of said first and second legs further comprises a telescoping leg member disposed within the lower portion of each said leg, wherein said telescoping leg member may be moved to adjust the length of each said leg.

5. The table according to claim 1 wherein said at least two leg assemblies comprise a first leg assembly and a second leg assembly pivotally connected at a respective first and second ends of the table frame by connecting elbows such that the first and second leg assemblies may be folded inwardly and under the table frame in alternating sequence during collapsing of the supporting structure so that the table frame and each leg assembly are generally disposed in parallel relationship to one another.

6. The table according to claim 1 wherein said at least two leg assemblies comprise a first leg assembly and a second leg assembly pivotally connected at a respective first and second ends of the table frame by reverse connecting elbows such that the first and second leg assemblies may be folded outwardly and over the table frame in alternating sequence during collapsing of the supporting structure so that the table frame and each leg assembly are generally disposed in parallel relationship to one another.

7. The table according to claim 1, further comprising at least one locking member attached between the table frame and a leg.

8. The table according to claim 7, wherein the at least one locking member comprises a locking member is attached between each leg of each leg assembly and the table frame.

9. The table according to claim 8, wherein each locking member remains attached between the table frame and a corresponding leg during collapsing of the supporting assembly to a portable condition.

10. The table according to claim 8, wherein each locking member is detachable from at least one of the table frame or the leg to which it is attached for collapsing of the supporting structure to a portable condition.

11. The table according to claim 1, wherein the tabletop is removable from the supporting structure such that the tabletop is independently collapsible from the supporting structure when the tabletop is removed from the supporting structure.

12. The table according to claim 1 wherein said at least two leg assemblies comprise a first leg assembly pivotally connected at the ends of the outer rail members of the parallelly disposed telescoping rail members and a second leg assembly pivotally connected at the ends of the inner rail members of the parallelly disposed telescoping rail members.

13. A portable and collapsible table comprising:

a tabletop; and a supporting structure comprising:

a table frame comprising a pair of parallelly disposed telescoping rail members;

at least two leg assemblies each being pivotally connected to the table frame, wherein each leg assembly comprises a first leg and a second leg pivotally connected together, said leg assembly being movable between an open position and a closed position wherein in said open position, the first and second legs being disposed in a generally X-shaped condition, and wherein in said closed position, the first and second legs being disposed in a generally parallel condition; and a locking member attached between each leg of each leg assembly and the table frame;

wherein said tabletop and said supporting structure are collapsible to a portable condition.

14. The table according to claim 13, wherein each locking member remains attached between the table frame and a corresponding leg during collapsing of the supporting assembly to a portable condition.

15. The table according to claim 13, wherein the tabletop is removable from the supporting structure such that the tabletop is independently collapsible from the supporting structure when the tabletop is removed from the supporting structure.

16. The table according to claim 13, wherein each rail member comprises an outer rail member and an inner rail member disposed within the outer rail member for telescoping movement relative thereto, said outer rail member defining an interior cavity substantially extending the entire length of the outer rail member that is not blocked by a mounting provided on the outer rail member for attaching a respective locking member to the outer rail member such that said mounting does not interfere with the telescoping movement of the respective inner rail member within the interior cavity.

17. The table according to claim 16, wherein the mounting comprises a rivet boss projecting outwardly from the exterior surface of each outer rail member that receives a rivet connection to attach the locking member to the outer rail member.

* * * * *